United States Patent [19]

Sasaoka et al.

[11] Patent Number: 4,997,743

[45] Date of Patent: Mar. 5, 1991

[54] SILVER HALIDE PHOTOGRAPHIC MATERIAL AND METHOD FOR FORMING IMAGE USING THE SAME

[75] Inventors: Senzo Sasaoka; Nobuaki Inoue; Eiichi Okutsu, all of Kanagawa, Japan

[73] Assignee: Fuji Photo Film Co., Ltd., Kanagawa, Japan

[21] Appl. No.: 463,825

[22] Filed: Jan. 8, 1990

Related U.S. Application Data

[63] Continuation of Ser. No. 259,407, Oct. 17, 1988, abandoned, which is a continuation of Ser. No. 849,635, Apr. 9, 1986, abandoned.

[30] Foreign Application Priority Data

Apr. 9, 1985 [JP] Japan ..... 60-77489

[51] Int. Cl.[5] ..... G03C 1/42

[52] U.S. Cl. ..... 430/264; 430/438; 430/464; 430/481; 430/566

[58] Field of Search ..... 430/264, 566, 438, 464, 430/481

[56] References Cited

U.S. PATENT DOCUMENTS 4,377,634 3/1983 Mifune et al. ..... 430/440
4,385,108 5/1983 Takagi et al. ..... 430/264
4,447,522 5/1984 Hirano et al. ..... 430/264
4,560,638 12/1985 Loblaw et al. ..... 430/264

FOREIGN PATENT DOCUMENTS 0209010 3/1986 European Pat. Off. .

*Primary Examiner*—Hoa Van Le
*Attorney, Agent, or Firm*—Sughrue, Mion, Zinn, Macpeak & Seas

[57] ABSTRACT

Silver halide photographic material and method of forming an image using the same are disclosed. The material comprises one or more silver halide emulsion layers on a support, with a hydrazine derivative and a developing agent being incorporated in at least one of said emulsion layers. The image forming method comprises performing imagewise exposure of the above-described photographic material and developing said material with a developing solution that contains sulfite ions in a concentration of not less than 0.15 mole per liter and which has a pH within the range of from 9.5 to 12.3, and provides a supercontrasty negative image that has a very contrasty photographic characteristic of a gamma ($\gamma$) of 10 or more and which is not highly susceptible to the occurrence of "black spots".

19 Claims, No Drawings

SILVER HALIDE PHOTOGRAPHIC MATERIAL AND METHOD FOR FORMING IMAGE USING THE SAME

This is a continuation of application Ser. No. 07/259,407, filed Oct. 17, 1988, now abandoned, which is a Cont. Appln. of application Ser. No. 06/849,635 filed Apr. 9, 1986 (now abandoned).

FIELD OF THE INVENTION

The present invention relates to a silver halide light-sensitive material and a method for forming a supercontrasty negative image in process photography using the material.

BACKGROUND OF THE INVENTION

Processes in the graphic arts require the use of an image forming system having a very high contrasty photographic characteristic, particularly one with a gamma ($\gamma$) of 10 or more, in order to attain faithful reproduction of halftone images or line drawing images by means of dot images.

This object has heretofore been achieved by using a specialized developing solution generally referred to as a lithographic developer. The lithographic developer contains hydroquinone as the sole developing agent and, in order to ensure the desired infectious development, a sulfite is used as a preservative in the form of adduct with formaldehyde so that the concentration of free sulfite ions is held very low, typically no more than 0.1 mole per liter. This lithographic developer however has a serious defect in that it is easily oxidized by air, and, consequently, it cannot be stored any longer than 3 days.

One conventional method for attaining a high-contrast photographic characteristic using a stable developing solution relies on the use of hydrazine derivatives as disclosed in U.S. Pat. Nos. 4,224,401, 4,168,977, 4,166,742, 4,311,781, 4,272,606, 4,211,857 and 4,243,739. This method provides supercontrasty and high-speed photographic characteristics and has the advantage of permitting the incorporation of a sulfite in the developing solution in high concentrations, with the result that the developing solution is rendered much more stable to aerial oxidation than the lithographic developer. However, this improved image forming system, capable of achieving a markedly high-speed and contrasty characteristic, causes "black spots" due to infectious development, which is quite undesirable for the purpose of attaining good results in process photography. These black spots, also known as "black pepper", occur in the areas between dots, which areas should not be developed, and their occurrence increases as a result of prolonged storage of the photographic material, especially when subjected to a hot and humid atmosphere. If the developing solution is exhausted as a result of repeated use, the level of sulfite ions in the preservative is lowered and its pH increased, and this is another cause of frequent occurrence of "black pepper". Since light-sensitive materials with "black pepper" have a very low commercial value and are not really suitable for use in process photography, considerable efforts have been made to eliminate this problem. However, a light-sensitive material having reduced "black pepper" often suffers from a degraded sensitivity and gamma ($\gamma$) characteristic, and is also undesirable for commercial use. A strong need has therefore existed for providing an image-forming system that has reduced "black pepper" without compromising the desirable high-speed and contrastive photographic characteristic.

SUMMARY OF THE INVENTION

The primary object, therefore, of the present invention is to provide a method of forming a supercontrasty negative image that has a very contrasty photographic characteristic of a gamma ($\gamma$) of 10 or more, and which is not highly susceptible to the occurrence of "black spots".

This object of the present invention can be attained by a photographic material that has one or more silver halide emulsion layers on a support, with a hydrazine derivative and a developing agent being incorporated in at least one of said emulsion layers. Said object can also be attained by a photographic image forming method which comprises performing imagewise exposure of the photographic material described above and developing the same with a developing solution that contains sulfite ions in a concentration of not less than 0.15 mole per liter and which has a pH within the range of from 9.5 to 12.3.

DETAILED DESCRIPTION OF THE INVENTION

The developing agent for use in the photographic material of the present invention is selected from among known compounds such as ascorbic acids (e.g., L-ascorbic acid), dihydroxybenzenes (e.g., hydroquinone), 3-pyrazolidones (e.g., 1-phenyl-3-pyrazolidone and 4,4-dimethyl-1-phenyl-3-pyrazolidone) and aminophenols (e.g., N-methyl-p-aminophenol). These developing agents may be used either singly or in combination.

Dihydroxybenzenes and ascorbic acids are not highly effective if they are used independently and, hence, they are preferably used in combination with 3-pyrazolidones or aminophenols. Preferable combinations include those of ascorbic acids and 3-pyrazolidones, of ascorbic acids and aminophenols, of dihydroxybenzenes and 3-pyrazolidones, and of dihydroxybenzenes and aminophenols.

For the purpose of the present invention, the combined use of two or more developing agents is preferable, and taking the combination of a dihydroxybenzene or ascorbic acid with 3-pyrazolidone or aminophenol as an example, the molar ratio of the former to the latter preferably ranges from 1 to 50, more preferably from 2 to 50, and most preferably from 3 to 20. If desired, three or more developing agents may be used in combination, such as in the case of ascorbic acids combined with 3-pyrazolidones and aminophenols.

If two or more developing agents are incorporated in the photographic material, the sum of their respective amounts generally ranges from 0.2 to 0.001 mole, and preferably from 0.1 to 0.005 mole, per mole of silver in the silver halide emulsion layer. A photographic material containing these amounts of developing agents is not adapted to treatment with an activator (which does not contain any developing agent and contains only an alkali) since an extremely low image density will result from such treatment. The developing agent may be added at any stage of the photographic processing if it is after the formation of silver halide grains in emulsion and not later than the coating of the emulsion. The temperature of the emulsion at the time when the developing agent is incorporated therein is preferably not lower than 20° C. and its pH is preferably 5.0 or more.

If desired, the developing agent may be added to the emulsion at a pH below 5.0, and, subsequently, the pH is increased to 5.0 or higher. Alternatively, the developing agent may be added to the emulsion at a pH of 5.0 or more and its pH is decreased to less than 5.0 just before the emulsion is coated onto a support. If dihydroxybenzenes are used, the pH of the emulsion is preferably held at a value no higher than 10, in order to avoid gelatin aggregation.

In addition to the developing agent, the photographic material of the present invention may contain various additives commonly incorporated in developing solutions, such as pH buffers (e.g., sulfites, carbonates, borates and phosphates of alkali metals), as well as development restrainers or anti-foggants illustrated by bromides, iodides and organic anti-foggants (with nitroindazoles and benzotriazoles being particularly preferred). If desired, water softeners, solubilizing agents, toning agents, development accelerators, surfactants (with polyalkylene oxides being particularly preferred), defoaming agents, and hardeners may be incorporated in the emulsion. In one embodiment, the developing agent may be added to the emulsion in the form of a developing solution. If the developing agent is added in an amount exceeding 0.2 mole per mole of silver, the keeping quality of the photographic material is markedly deteriorated and desensitization or fogging will occur during storage under natural conditions.

The developing agent is preferably added either to an emulsion in which silver halide grains have been formed or to an emulsion coating solution just before its application to a support. The developing agent may of course be added to a protective layer or a subbing layer so that it may later diffuse into the underlying emulsion layer from the applied protective or subbing layer, but the addition to the emulsion or emulsion coating solution is much more effective for the purpose of minimizing the occurrence of "black spots".

After an emulsion containing the developing agent is coated onto a support, the surface of the emulsion layer may be washed with water so as to remove part of the developing agent, thereby reducing its content in the emulsion layer.

Examples of the hydrazine derivative used in the present invention include the sulfinyl containing hydrazine derivatives disclosed in U.S. Pat. No. 4,478,928, and the compounds represented by formula (I):

$$R_1\text{—NHNH—CHO} \qquad \text{(I)}$$

wherein $R_1$ is an aliphatic or aromatic group.

The aliphatic group denoted by $R_1$ in formula (I) is preferably one having 1 to 30 carbon atoms, with a straight-chained, branched or cyclic alkyl group having 1 to 20 carbon atoms being particularly preferred. The branched alkyl group may be cyclized to form a saturated hetero ring containing one or more hetero atoms. The alkyl group represented by $R_1$ may have a substituent such as an aryl, alkoxy, sulfoxy, sulfonamido or carbonamido group. Illustrative alkyl groups include t-butyl, n-octyl, t-octyl, cyclohexyl, pyrrolidyl, imidazolyl, tetrahydrofuryl, and morpholino groups.

The aromatic group denoted by $R_1$ in formula (I) can be a mono- or bicyclic aryl group or an unsaturated heterocyclic group. The unsaturated heterocyclic group may be fused to the mono- or bicyclic aryl group to form a heteroaryl group. Examples of the aromatic group represented by $R_1$ include benzene, naphthalene, pyridine, pyrimidine, imidazole, pyrazole, quinoline, isoquinoline, benzimidazole, thiazole and benzothiazole rings, with an aromatic group containing the benzene ring being preferred. An aryl group is particularly preferable as the aromatic group represented by $R_1$. This aryl group or other aromatic groups denoted by $R_1$ may have a substituent. Typical substituents include a straight-chained, branched or cyclic alkyl group (with one having 1 to 20 carbon atoms being preferred), an aralkyl group (with a mono- or bicyclic aralkyl group having 1 to 3 carbon atoms in the alkyl portion being preferred), an alkoxy group (preferably containing 1 to 20 carbon atoms), a substituted amino group (preferably one substituted by an alkyl group containing from 1 to 20 carbon atoms), an acylamino group (preferably containing 2 to 30 carbon atoms), a sulfonamido group (preferably containing 1 to 30 carbon atoms), and a ureido group (preferably containing 1 to 30 carbon atoms).

The aliphatic or aromatic group denoted by $R_1$ in formula (I) may incorporate a ballast group of a type commonly used in couplers and other immobilized photographic additives. The ballast group has 8 or more carbon atoms and is comparatively inert to photographic processing solutions. Suitable ballast groups are alkyl, alkoxy, phenyl, alkylphenyl, phenoxy, and alkylphenoxy groups.

The aliphatic or aromatic group represented by $R_1$ in formula (I) may also incorporate a group that imparts enhanced adsorption to the surfaces of silver halide grains. Illustrative adsorptive groups include the thiourea, heterocyclic thioamido, mercapto heterocyclic and triazole groups, and other groups as described in U.S. Pat. No. 4,385,108.

The compounds of formula (I) may be synthesized by any of the methods disclosed in Japanese patent application (OPI) Nos. 20921/78, 20922/78, 66732/78 and 20318/78 (the term "OPI" as used herein referes to a "published unexamined Japanese patent application").

For the purposes of the present invention, the hydrazine derivative is preferably incorporated in a light-sensitive silver halide emulsion layer in the photographic material, but it is to be understood that this compound may also be contained in any other hydrophilic colloid layers such as a protective layer, an intermediate layer, a filter layer and an anti-halation layer. Stated more specifically, a particular hydrazine compound may be added to a hydrophilic colloid solution in the form of an aqueous solution if it is water-soluble, and in the form of a solution in a water-miscible organic solvent (e.g., alcohols, esters or ketones) if said compound is sparingly water-soluble. If the hydrazine derivative is directly added to a silver halide emulsion layer, its addition may be effected at any time after initiation of chemical ripening and before application of the emulsion coating solution, but it is preferably added at a time after completion of chemical ripening and before the application of the coating solution. Particularly good results are obtained if the hydrazine derivative is added to a separate emulsion coating solution.

Desirably, the hydrazine derivative is used in an optimal amount that may be determined depending upon the size of grains in a silver halide emulsion, the halide composition, the method and degree of chemical sensitization, the relationship between the layer in which said derivative is incorporated and the silver halide emulsion layer, and the type of the anti-foggant agent used. The procedures of testing conducted for the purpose of selecting an optimal amount of the hydrazine derivative are well known to those skilled in the art. Typically, the hydrazine compound is employed in an amount ranging from $10^{-6}$ to $10^{-1}$ mole per mole of silver halide, with the range of $1\times10^{-5}$ to $4\times10^{-2}$ mole per mole of silver halide being preferred.

Specific examples of the compound of formula (I) are listed below, but it should be understood that these are not the only examples of the hydrazine compounds that can be used in the present invention.

I-1

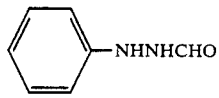

I-2

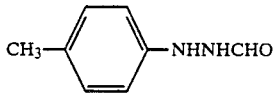

I-3

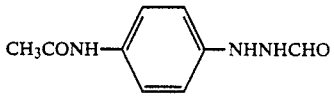

I-4

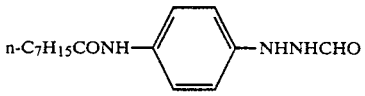

I-5

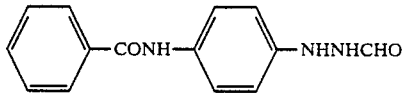

I-6

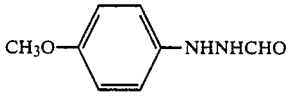

I-7

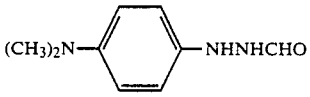

I-8

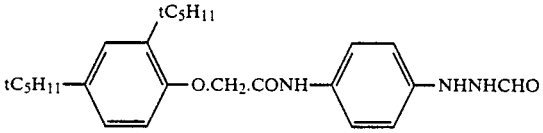

I-9

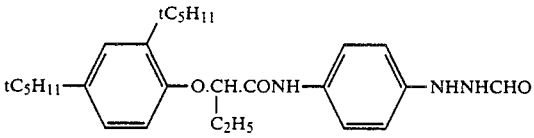

I-10

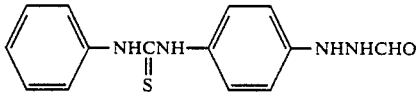

I-11

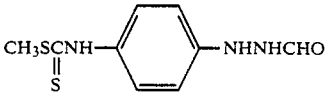

I-12

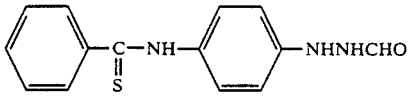

-continued
I-13
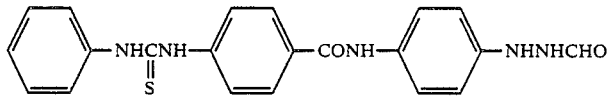
I-14
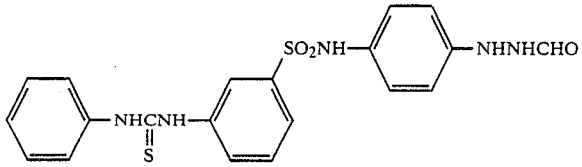
I-15
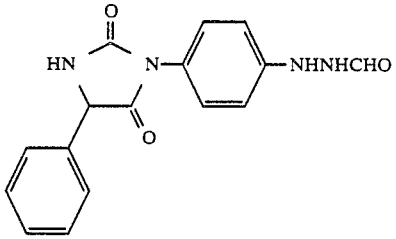
I-16
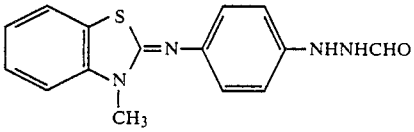
I-17
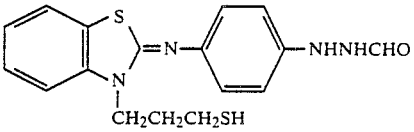
I-18
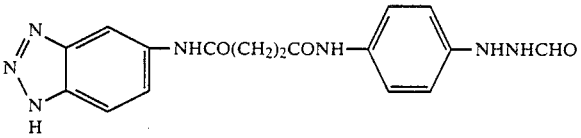
I-19
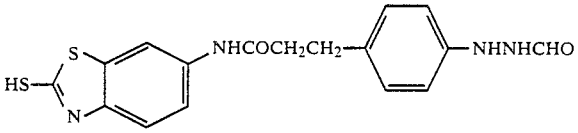
I-20
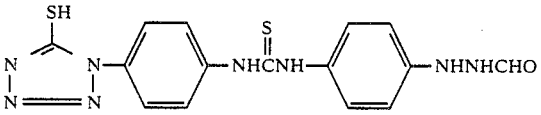
I-21
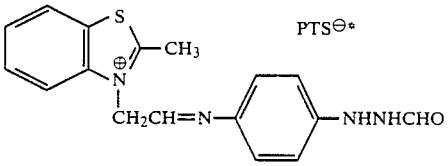
I-22
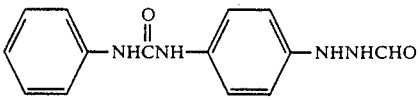

-continued
I-23
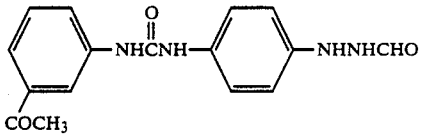
I-24
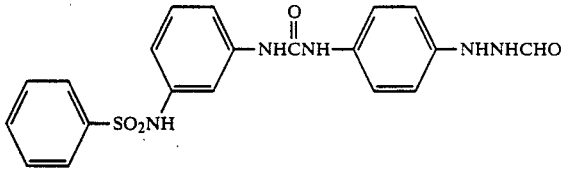
I-25
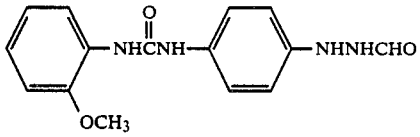
I-26
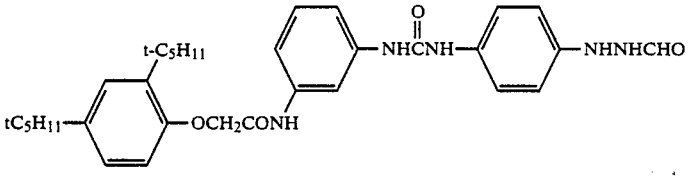
I-27
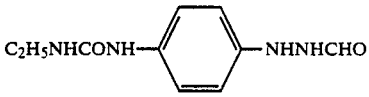
I-28
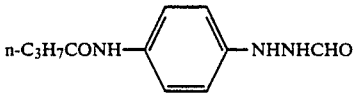
I-29
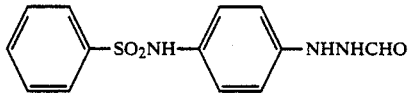
*PTS⊖ means a para-toluenesulfonic acid represented by the following formula
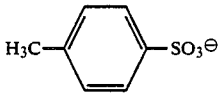
The following hydrazine derivatives disclosed in U.S. Pat. No. 4,478,928 may also be used in the present invention.
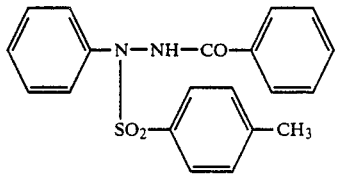
-continued
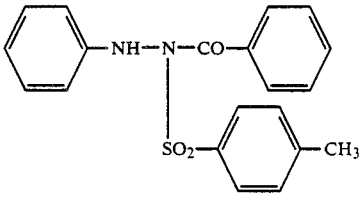

-continued

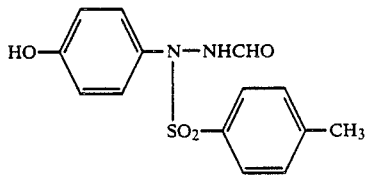

The silver halide emulsion suitable for use in the present invention may have any halide composition such as silver chloride, silver chlorobromide, silver iodobromide or silver iodochlorobromide. A silver halide containing at least 70 mol % silver bromide is preferable, with one having a silver bromide content of at least 90 mol % being particularly preferred. The content of silver iodide is preferably no more than 10 mol %, with the range of 0.1 to 5 mol % being more preferable.

The silver halide used in the present invention is preferably fine grained with an average size of, say, 0.7 μm or below, and grains no larger than 0.5 μm are particularly preferred.

Gelatin is an advantageous binder or protective colloid for use in a photographic emulsion, but other hydrophilic colloids may also be used, including proteins such as gelatin derivatives, gelatin modified with other polymer grafts, albumin, and casein; cellulose derivatives such as hydroxymethyl cellulose, carboxymethyl cellulose and cellulose sulfate esters; saccharide derivatives such as sodium alginate and starch derivatives; and many synthetic hydrophilic high-molecular weight as homopolymers or copolymers such as polyvinyl alcohol, polyvinyl alcohol partially modified with acetal, poly-N-vinylpyrrolidone, polyacrylic acid, polymethacrylic acid, polyacrylamide, polyvinyl imidazole, and polyvinyl pyrazole.

The silver halide emulsion used in the present invention may or may not be chemically sensitized. It is known that silver halide emulsions can be chemically sensitized by sulfur sensitization, reduction sensitization or noble metal sensitization, and these methods may be employed either independently or in combination.

Gold sensitization is a typical method of noble metal sensitization, and gold compounds, especially gold complex salts, are commonly used. They may contain complex salts of non-gold noble metals such as platinum, palladium, rhodium and iridium. Specific examples of such complex salts are disclosed in, for example, U.S. Pat. No. 2,448,060 and British Pat. No. 618,061.

Water-soluble iridium salts or iridium complex salts may be employed and they include iridium trichloride, iridium tetrachloride, potassium hexachloroiridate (III), potassium hexachloroiridate (IV) and ammonium hexachloroiridate (III).

Sulfur compounds contained in gelatin may be employed as sulfur sensitizers, and a variety of other sulfur compounds such as thiosulfates, thioureas, thiazoles and rhodanines may also be used in sulfur sensitization.

Usable reduction sensitizers include stannous salts, amines, formamidinesulfinic acid, and silane compounds.

With a view to attaining a higher sensitivity, the photographic material used in the present invention may contain sensitizing dyes (e.g., cyanine and merocyanine dyes) as described at pages 45 to 53 of the specification of Japanese patent application (OPI) No. 52050/80. Such sensitizing dyes may be used either independently or in combination, the latter method being often used for the particular purpose of supersensitization. The emulsion may contain both a sensitizing dye and a dye that is not a spectral sensitizer per se or a substance that is substantially incapable of absorbing visible light and which exhibits supersensitization. Useful sensitizing dyes, combinations of supersensitizing dyes, and substances that exhibit supersensitization are listed on page 23, IV-J of *Research Disclosure*, Vol. 176, No. 17643, December, 1978.

The photographic material used in the present invention may contain a variety of compounds for the purpose of preventing fogging of the material or stabilizing its photographic performance during production, storage, or photographic processing. A multitude of antifoggants or stabilizers are available for this purpose and they include azoles, such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles, etc.; mercaptopyrimidines; mercaptotriazines; thioketo compounds such as oxazolinthione; azaindenes such as triazaindenes, tetrazaindenes [hydroxy-substituted (1,3,3*a*, 7) tetrazaindenes, in particular] and pentazaindenes; and benzenethiosulfonic acid, benzenensulfinic acid and benzenesulfonic acid amide. Among these compounds, benzotriazoles (e.g., 5-methyl-benzotriazole) and nitroindazoles (e.g., 5-nitroindazole) are preferable. The compounds listed above may be incorporated in an appropriate processing solution rather than in the photographic material per se.

The photographic material of the present invention may also contain inorganic or organic hardeners in a photographic emulsion layer or in other hydrophilic colloid layers. Suitable hardeners include chromium salts (e.g., chrome alum and chromium acetate, etc.), aldehydes (e.g., formaldehyde, glyoxal and glutaraldehyde, etc.), N-methylol compounds (e.g., dimethylolurea and methylol dimethylhydantoin, etc.), dioxane derivatives (e.g., 2,3-dihydroxydioxane, etc.), activated vinyl compounds (e.g., 1,3,5-triacryloyl-hexahydro-s-triazine and 1,3-vinylsulfonyl-2-propanol, etc.), activated halogen compounds (e.g., 2,4-dichloro-6-hydroxy-s-triazine, etc.), and mucohalogenic acids (e.g., mucochloric acid and mucophenoxychloric acid, etc.). These compounds may be used either independently or in combination.

Photographic emulsion layers and other hydrophilic colloid layers in the light-sensitive material of the present invention may also contain a variety of surfactants for various purposes, such as assisting in coating operations, prevention of static buildup, providing improved slip properties, producing the desired emulsion (or dispersion), anti-blocking, and providing improved photographic characteristics (e.g., acceleration of development, providing a highly contrasty image, and sensitization).

Examples of suitable surfactants include: nonionic surfactants such as saponin (steroid type), alkylene oxide derivatives (e.g., polyethylene glycol, polyethylene glycol/polypropylene glycol condensates, polyethylene glycol alkyl or alkylaryl ethers, polyethylene glycol esters, polyethylene glycol sorbitan esters, polyalkylene glycol alkylamines or amides, and polyethylene oxide adducts of silicone), glycidol derivatives (e.g., alkenylsuccinic acid polyglycerides and alkylphenol polyglycerides), aliphatic acid esters of polyhydric alcohols, and alkyl esters of saccharides; anionic surfactants containing acidic groups such as a carboxyl group, a sulfo group, a phospho group, a sulfate ester group or a phosphate ester group, as illustrated by alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters; amphoteric surfactants such as amino acids, aminoalkylsulfonic acids, aminoalkylsulfuric or phosphoric acid esters, alkylbetaines, and amine oxides; and cationic surfactants such as alkylamine salts, aliphatic or aromatic quaternary ammonium salts, heterocyclic quaternary ammonium salts such as pyridinium and imidazolium salts, and aliphatic or heterocyclic phosphonium or sulfonium salts.

The polyalkylene oxides with molecular weight of 600 or higher that are described in Japanese Patent Publication No. 9412/83 are preferably used in the present invention as surfactants.

Photographic emulsion layers and other hydrophilic colloid layers in the photographic material of the present invention may contain an anti-blocking matting agent such as silica, magnesium oxide or polymethyl methacrylate.

The photographic material of the present invention may contain dispersions of water-insoluble or sparingly water-soluble synthetic polymers for the purpose of providing improved dimensional stability. Usable polymers include those which are composed of one or more of monomers such as alkyl (meth)acrylates, alkoxyalkyl (meth)acrylates, glycidyl (meth)acrylates, (meth)acrylamides, vinyl esters (e.g., vinyl acetate), acrylonitrile, olefins and styrene, as well as polymers comprising these monomer components in combination with other monomers such as acrylic acid, methacrylic acid, $\alpha$, $\beta$-unsaturated dicarboxylic acids, hydroxyalkyl (meth)acrylate, sulfoalkyl (meth)acrylates, and styrenesulfonic acid. Specific examples of usable polymers are described in U.S. Pat. Nos. 2,376,005, 2,739,137, 2,853,457, 3,062,674, 3,411,911, 3,525,620, 3,607,290 and 3,645,740.

The silver halide photographic material of the present invention may be provided with a supercontrasty and high-speed photographic characteristic by means of using a stable developing solution instead of a conventional infectious developing solution or the highly alkaline (pH≃13) developing solution described in U.S. Pat. No. 2,419,975. By the term "stable developing solution" is meant one that contains no less than 0.15 mole/1,000 ml of sulfite ions as a preservative and which has a pH in the range of 9.5 to 12.3, preferably 10.5 to 12.3, and processing with this developing solution is sufficient to produce the desired supercontrasty negative image.

There is not particular limitation on the developing agent that can be used in the practice of the method of the present invention, and dihydroxybenzenes (e.g., hydroquinone), 3-pyrazolidones (e.g., 1-phenyl-3-pyrazolidone and 4,4-dimethyl-1-phenyl-3-pyrazolidone) and aminophenols (e.g., N-methyl-p-aminophenol) may be used either alone or in combination.

The silver halide photographic material of the present invention is particularly adapted to processing with a developing solution containing a dihydroxybenzene as the principal developing agent and a 3-pyrazolidone or aminophenol as the auxiliary developing agent. It is particularly preferable that this developing solution contains from 0.05 to 0.5 mole/1,000 ml of a dihydroxybenzene and not more than 0.06 mole/1,000 ml of a 3-pyrazolidone or aminophenol.

If desired, the rate of development may be increased and its duration shortened by adding amines to the developing solution as taught in U.S. Pat. No. 4,269,929.

The developing solution may contain a pH buffer selected from among sulfites, carbonates, borates and phosphates of alkali metals, and development retarders or antifoggants such as bromides, iodides or organic anti-foggants (with nitroindazoles or benzotriazoles being particularly preferred). If desired, the developing solution may also contain a water softening agent, a solubilizing agent, a toning agent, a development accelerator, a surfactant (preferably selected from among the polyalkylene oxides listed above), a defoaming agent, a hardener or an agent that prevents silver smudging of films (e.g., 2-mercaptobenzimidazole sulfonic acid).

A fixing bath with a common formulation may be employed in the practice of the method of the present invention. Suitable fixing agents include thiosulfates, thiocyanates, and any organic sulfur compounds that are known to have the capability of working as fixing agents. The fixing solution may contain a water-soluble aluminum salt as a hardener.

In accordance with the method of the present invention, the photographic material is typically processed at temperatures within the range of 18° to 50° C. An automatic developer is preferably employed, and negative images with a satisfactorily supercontrasty photographic characteristic can be obtained with the light-sensitive material by practicing the method of the present invention even if the total duration of processing with the automatic developer is set to a value between 90 and 120 seconds.

The following examples are provided for the purpose of further illustrating the present invention but are by no means intended to limit the same.

EXAMPLE 1

To an aqueous gelatin solution held at 50° C, an aqueous solution of silver nitrate and an aqueous solution of potassium iodide and potassium bromide were simultaneously added over a period of 60 minutes in the presence of $4\times10^{-7}$ mole of potassium hexachloroiridate (III) per mole of Ag and ammonia while the pAg was kept at 7.8, as a result of which an emulsion of monodispersed cubic grains (average size: 0.25 $\mu$m) with an average silver iodide content of 1 mol% were produced. To the resulting silver iodobromide emulsion, a sodium salt of 5,5'-dichloro-9-ethyl-3,3'-bis(3-sulfopropyl)oxacarbocyanine was added as a sensitizing dye, while 4-hydroxy-6-methyl-1,3,3*a*, 7-tetrazaindene as a stabilizer, a dispersion of polyethylene acrylate, as a binder, and polyethylene glycol as a development accelerator were added. The pH of the resulting emulsion coating solution was adjusted to 6.0. To the thus prepared coating solution, 0.001 mole/mole Ag of 4-methyl-hydroxymethyl-1-phenyl-3-pyrazolidone and 0.025 mole/mole Ag of L-ascorbic acid were added as developing agents. Following the addition of sodium metaborate, the coating solution was agitated at 40° C. for 5 minutes. Thereafter, 1,3-vinylsulfonyl-2-propanol and $3\times10^{-3}$ mole/mole Ag of Compound I-9 were added, and the resulting coating solution was applied to a polyethylene terephthalate film, thereby forming an emulision layer with a silver deposit of 3.4 g/m$^2$. The emulsion layer was then coated with a protective layer gelatin content: 1.0 g/m$^2$) containing sodium dodecylbenzenesulfonate as a coating aid and polymethyl methacrylate (average grain size: 3.0 μm) as a matting agent. The so prepared photographic material was referred to as Sample A.

Sample B was prepared by repeating the above procedures except that the 4-methyl-hyroxymethyl-1-phenyl-3-pyrazolidone was replaced by 0.001 mole/mole Ag of N-methyl-p-aminophenol hemisulfate.

Sample C, a comparative sample, was prepared by repeating the above procedures except that neither 4-methyl-hydroxymethyl-1-phenyl-3-pyrazolidone nor L-ascorbic acid was used.

Two units of each sample were exposed under a tungsten lamp (500 W, 3,200K) through an optical wedge for 5 seconds, and one group of the samples was developed with a developing solution (for its formulation, see below) at 38° C. for 30 seconds, and the other group was likewise developed for 40 seconds. The sensitivity, gamma (γ) and "black spot" data of each of the processed samples are shown in Table 1.

| Developer formulation: | |
|---|---|
| Hydroquinone | 35.0 g |
| N-methyl-p-aminophenol hemisulfate | 0.8 g |
| Sodium hydroxide | 9.0 g |
| Potassium triphosphate | 74.0 g |
| Potassium sulfite | 90.0 g |
| Ethylenediaminetetraacetic acid disodium salt | 1.0 g |
| 3-Diethyl-amino-1-propanol | 15.0 g |
| 5-Methylbenzotriazole | 0.5 g |
| Sodium bromide | 3.0 g |
| Water | to make 1,000 ml |
| pH | adjusted to 11.60 |

TABLE 1

| Sample No. | Photographic Material | Development Time (sec) | Photographic Performance Sensitivity(1) | Black Spots(2) | Gamma (γ) |
|---|---|---|---|---|---|
| 1 (comparative sample) | Sample C | 30 | 100 | 1.5 | 14 |
| 2 (comparative sample) | " | 40 | 107 | 1.0 | 15 |
| 3 (sample of this invention) | Sample A | 30 | 98 | 5.0 | 14 |
| 4 (sample of this invention) | " | 50 | 107 | 5.0 | 15 |
| 5 (sample of this invention) | Sample B | 30 | 100 | 5.0 | 14 |
| 6 (sample of this invention) | " | 40 | 110 | 5.0 | 15 |

Notes:
(1)The sensitivity is expressed as the reciprocal of the exposure necessary to provide a density of 1.5 by development at 38° C. for 30 seconds and is indicated as a relative value, with the value for sample No. 1 being taken as 100.
(2)The "black spots" were evaluated by rating indices of 1 to 5 on the basis of microscopic observation: the best quality and acceptable quality are indicated by "5" and "4", respectively; "3" is poor but barely acceptable; "2" and "1" are unacceptable; and "1.5" is an intermediate between "1" and "2".
(3)The gamma (γ) is the gradient of the tangent line at density 1.5 on the characteristic curve.

As is clear from Table 1, samples A and B each incorporating the developing agents specified by the present invention had a reduced number of "black spots" without sacrificing the sensitivity or gamma (γ).

EXAMPLE 2

Silver halide grains in emulsion were formed as in Example 1. Before washing the emulsion with water, 0.005 mole/mole Ag of 4-methyl-hydroxymethyl-1-phenyl-3-pyrazolidone and 0.025 mole/mole Ag of hydroquinone were added as developing agents, and, at the same time, 5 g/mole Ag of potassium sulfite and 1.25 g/mole Ag of sodium metaborate tetrahydrate were added. The emulsion having a pH of 8.5 was then agitated at 40° C. for 3 minutes and, after being washed with water as in the conventional practice of emulsion preparation, the emulsion was adjusted to a pH of 5.8 and post-ripened. The so prepared emulsion was referred to as Emulsion D.

Emulsion E was prepared by repeating the aforementioned procedures except that it was solely composed of 4-methyl-hydroxymethyl-1-phenyl-3-pyrazolidone and and hydroquinone as developing agents which were present in the same amounts as used in Emulsion D.

Emulsion F as a comparative sample was prepared by repeating the above-described procedures except that it contained neither of the two developing agents, nor did it contain potassium sulfite or sodium metaborate.

To each of the samples of silver iodobromide Emulsions D, E and F, the following compounds were added: a sodium salt of 5,5'-dichloro-9-ethyl-3-3'-bis(3-sulfopropyl) oxacarbocyanine as a sensitizing dye; and 4-hydroxy-6-methyl-1,3,3a 7-tetrazaindent as a stabilizer; a dispersion of polyethyl acrylate as a binder; polyethylene glycol as a development accelerator; 1,3-vinylsulfonyl-2-propanol; and $3\times10^{-3}$ mole/mole Ag of Compound I-9. Each of the emulsions was then coated onto a polyethylene terephthalate film as in Example 1, thereby producing samples of photographic material. The samples employing Emulsions D, E and F were respectively referred ot as Samples D, E and F.

To so prepared Samples D, E and F were exposed and developed as in Example 1, and the processed samples were checked for their sensitivity, gamma (γ) and resistance to the formation of black spots. The results are shown in Table 2.

TABLE 2

| Sample No. | Photographic Material | Development Time (sec) | Photographic Performance | | |
|---|---|---|---|---|---|
| | | | Sensitivity | Black Spots | Gamma (γ) |
| 7 (comparative sample) | Sample F | 30 | 100 | 1.5 | 14 |
| 8 (comparative sample) | " | 40 | 107 | 1.0 | 15 |
| 9 (sample of this invention) | Sample D | 30 | 102 | 5.0 | 15 |
| 10 (sample of this invention) | " | 40 | 115 | 4.5 | 16 |
| 11 (sample of this invention) | Sample E | 30 | 100 | 5.0 | 14 |
| 12 (sample of this invention) | " | 40 | 110 | 4.5 | 15 |

As is clear from Table 2, sample Nos. 9 to 12 wherein the developing agents specified by the present invention were incorporated in silver halide emulsions after the formation of silver halide grains were as resistant to the formation of "black spots" as sample Nos. 3 to 6, wherein the developing agents were added to emulsion coating solutions just before their application to a photographic support.

It is also clear from Tables 1 and 2 that the advantages of the developing agents specified by the present invention are not impaired by using them together with potassium sulfite and sodium metaborate, which are commonly incorporated in developing solutions as additives other than the developing agents.

While the invention has been described in detail and with reference to specific embodiments thereof, it will be apparent to one skilled in the art that various changes and modifications can be made therein without departing from the spirit and scope thereof.

What is claimed is:

1. An image forming method which comprises conducting imagewise exposure of a silver halide photographic material having at least one silver halide emulsion layer on a support, said at least one silver halide emulsion layer containing a contrast-promoting hydrazine compound represented by formula (I)

$$R_1\text{—NHNH—CHO} \qquad (I)$$

wherein $R_1$ represents a substituted or unsubstituted aliphatic group or a substituted or unsubstituted aromatic group in an amount of from $10^{-6}$ to $10^{-1}$ mole per mole of silver in said at least one silver halide emulsion layer, and at least one developing agent selected from the group consisting of ascorbic acids, hydroquinone, 3-pyrazolidones, and aminophenols in an amount of from 0.1 to 0.005 mole per mole of silver in said at least one silver halide emulsion layer, and developing said photographic material with a developing solution that contains sulfite ions in a concentration of not less than 0.15 mole per liter and a dihydroxybenzene as a developing agent in a concentration of 0.05 to 0.5 mole per liter and which has a pH within the range of from 10.5 to 12.3.

2. An image forming method as in claim 1, wherein the hydrazine compound is present in an amount of $1\times10^{-5}$ to $4\times10^{-2}$ mole per mole of silver halide.

3. An image forming method as in claim 1, wherein said developing solution contains a 3-pyrazolidone or an aminophenol as an auxiliary developing agent in a concentration of 0.06 mole per liter or less.

4. An image forming method as in claim 1, wherein said aliphatic group is a straight-chain, branched or cyclic alkyl group having 1 to 30 carbon atoms, and said aromatic group is a monocyclic or bicyclic aryl group or an unsaturated heterocyclic group.

5. An image forming method as in claim 4, wherein said branched alkyl group is cyclized to form a saturated hetero ring containing one or more hetero atoms, and said unsaturated heterocyclic group is fused to said monocyclic or bicyclic aryl group to form a heteroaryl group.

6. An image forming method as in claim 1, wherein substituents for said substituted aliphatic group include an aryl group, an alkoxy group, a sulfoxy group, a sulfonamido group and a carbonamido group, and substituents for said substituted aromatic group include a straight-chain, branched or cyclic alkyl group, an aralkyl group, an alkoxy group, a substituted amino group, an acylamino group, a sulfonamido group and a ureido group.

7. An image forming method as in claim 1, wherein the group represented by $R_1$ contains a ballast group having 8 or more carbon atoms.

8. An image forming method as in claim 1, wherein the group represented by $R_1$ contains a group that imparts enhanced adsorption to the surfaces of silver halide grains.

9. An image forming method as in claim 1, wherein said at least one developing agent is present in a protective layer or a subbing layer of said photographic material.

10. An image forming method as in claim 1, wherein said hydrazine compound is present in at least one hydrophilic colloid layer selected from a protective layer, an intermediate layer, a filter layer and an antihalation layer.

11. An image forming method as in claim 1, wherein said at least one developing agent is selected from the group consisting of L-ascorbic acid, hydroquinone, 1-phenyl-3-pyrazolidone, 4,4-dimethyl-1-phenyl-3-pyrazolidone, 4-methyl-1-hydroxylmethyl-1-phenyl-3-pyrazolidone and N-methyl-p-amino-phenol.

12. An image forming method as in claim 11, wherein said developing agent is hydroquinone.

13. An image forming method as in claim 1, wherein said at least one silver halide emulsion contains silver halide grains having an average particle size of 0.7 μm or lower.

14. An image forming method as in claim 1, wherein said at least one silver halide emulsion contains silver halide grains comprising at least 70 mol % silver bromide and up to 10 mol % silver iodide.

15. An image forming method as in claim 14, wherein said silver halide grains comprise at least 90 mol % silver bromide and from 0.1 to 5 mol % silver iodide.

16. An image forming method as in claim 1 which provides a very contrasty photographic characteristic of a gamma of 10 or more.

17. An image forming method as in claim 11, wherein said developing agent is L-ascorbic acid.

18. An image forming method as in claim 11, wherein said developing agent is 1-phenyl-3-pyrazolidone.

19. An image forming method as in claim 11, wherein said developing agent is N-methyl-p-aminophenol.

* * * * *